United States Patent [19]

Kiyimaa et al.

[11] Patent Number: 5,054,105

[45] Date of Patent: Oct. 1, 1991

[54] ELECTRIC SAUNA HEATER UTILIZING A THERMOSTATIC CONTROL OF STEAM GENERATION AND SAUNA ROOM HEATING

[75] Inventors: Antti Kiyimaa, Kauniainen; Peter Sjölund, Ekenäs, both of Finland

[73] Assignee: Oy Helo-Tehtaat-Helo Factories, Ltd., Helsinki, Finland

[21] Appl. No.: 483,561

[22] Filed: Feb. 22, 1990

[51] Int. Cl.[5] ..... F24H 7/06; A61H 33/06

[52] U.S. Cl. ..... 392/394; 392/403; 392/405; 219/485

[58] Field of Search ..... 219/271-276, 219/362, 364-365, 378, 485; 392/394, 403, 405, 335; 4/524

[56] References Cited

U.S. PATENT DOCUMENTS

| | | | |
|---|---|---|---|
| 3,670,141 | 6/1972 | Dines . | |
| 3,721,802 | 3/1973 | Chrisman . | |
| 3,739,144 | 6/1973 | Janson | 219/362 |
| 3,892,946 | 7/1975 | Rimmi | 219/483 |
| 3,952,181 | 4/1976 | Reed | 219/275 |
| 4,717,811 | 1/1988 | Fujii | 219/483 |
| 4,835,368 | 5/1989 | Fortmann et al. | 219/273 |
| 4,851,646 | 7/1989 | Perala | 219/483 |
| 4,959,527 | 9/1990 | Kivimaa et al. | 392/403 |

FOREIGN PATENT DOCUMENTS

| | | | |
|---|---|---|---|
| 667191 | 4/1934 | Fed. Rep. of Germany . | |
| 2427625 | 1/1975 | Fed. Rep. of Germany | 219/364 |
| 3404892 | 8/1985 | Fed. Rep. of Germany . | |
| 3405895 | 8/1985 | Fed. Rep. of Germany . | |
| 61-186741 | 8/1986 | Japan . | |
| 202491 | 5/1939 | Switzerland . | |

OTHER PUBLICATIONS

Darauf kommt es an: Heizgerat, Verdampfer und Wasserversorgung.

*Primary Examiner*—Bruce A. Reynolds
*Assistant Examiner*—John A. Jeffery
*Attorney, Agent, or Firm*—Brumbaugh, Graves, Donohue & Raymond

[57] ABSTRACT

An electric sauna heater comprising at least one electric resistor (10) for heating the sauna room and a steamer (1 to 9) for generating steam in the sauna room, the steamer comprising an evaporating space (4) and at least one electric resistor (9) for evaporating the water contained in the evaporating space (4). To achieve efficient evaporation without applying high capacities at the evaporating resistor, the sauna heater comprises a thermostat (5) which disconnects power from the water evaporating resistor (9) when opening the supply of water to the evaporating space (4) and connects power to the evaporating resistor (9) when closing the supply of water to the evaporating space (4).

7 Claims, 2 Drawing Sheets

ELECTRIC SAUNA HEATER UTILIZING A THERMOSTATIC CONTROL OF STEAM GENERATION AND SAUNA ROOM HEATING

This invention relates to an electric sauna heater comprising at least one electric resistor for heating the sauna room and a steamer for generating steam in the sauna room, the steamer comprising an evaporating space; at least one electric resistor for evaporating the water contained in the evaporating space; and thermostatic control means opening and closing a valve controlling water supply to the evaporating space, depending on the temperature of the evaporating space.

By means of the electric sauna heater defined above, the bathing conditions can be varied greatly. The apparatus can be used as a conventional sauna heater with temperatures ranging, e.g., from 70° to 100° C. and with a relative humidity less than 20%. In addition, it is also possible to generate steam in the sauna room by means of a steamer comprised in the sauna heater, whereby the temperature, of course, has to be lower. Bathing conditions obtained with temperatures ranging from 55° to 40° C. and a relative humidity ranging from 40 to 55% can be called "a soft steam bath" (SoftDampfbad in German). A conventional steam bath is achieved when the humidity is increased up to 100%, the temperature ranging from about 42° to 46° C. All or most of the above-mentioned bathing conditions can thus be achieved by means of one and the same sauna heater construction.

Klafs-Saunabau GmbH & Co. from the Federal Republic of Germany has introduced a sauna heater of the above type. The control means of the steamer of this sauna heater are separate from those of the sauna heater itself. The steamer comprises an evaporating space formed by a water-filled tank in which electric resistors are immersed. The electric resistors cause the water contained in the tank to boil, thus generating steam in the sauna room. This construction has many disadvantages. First, with this type of steamer the level of the surface of the water contained in the evaporating space has to be controlled accurately to prevent the drying of the heating resistors, which would lead to excessive surface temperatures and damage to the resistors. Second, all the water contained in the evaporating space has to be heated to the boiling temperature to produce steam, wherefore heating resistors having rather a high capacity have to be used to ensure sufficiently efficient evaporation within a reasonable period of time from the start-up of the apparatus. Third, the lime possibly present in the water to be evaporated tends to be deposited on the surface of the heating resistors, deteriorating their efficiency. The removal of deposited lime from the surface of the heating resistors is very problematic.

The present invention relates to an electric sauna heater comprising a steamer so constructed that the above-mentioned problems associated with an electric sauna heater provided with a steamer known from the prior art can be eliminated. This is achieved by means of an electric sauna heater of the invention, which is characterized in that the thermostatic control means disconnect power from the water evaporating resistor(s) when opening the supply of water to the evaporating space and connect power to the evaporating resistor(s) when closing the supply of water to the evaporating space. In this way water is fed into the evaporating space in small doses, which enables the evaporation to be started rapidly. A decrease in the amount of water contained in the steamer raises the water temperature as a result of which the supply of power to the water evaporating resistor is disconnected and a valve supplying additional water to the evaporating space is opened. The control according to the invention enables the evaporating resistor to be disposed outside the evaporating space in direct contact with it so that the depositing of lime on the resistor, for instance, is eliminated. The proper evaporating space thereby forms a kind of boiler, from which the deposited lime can be removed very simply, by means of a weak acetic acid solution, for instance. On the other hand, the bottom of the evaporating space comprises a structurally separate part easy to detach, so it is also easily replaceable.

According to one particularly advantageous embodiment of the sauna heater of the invention, the thermostatic control means are arranged to disconnect/connect power from/to at least one heating resistor of the sauna heater when they connect/disconnect power to/from the water evaporating resistor(s). In this way it is possible to reduce the supply of power to the heating resistors of the sauna heater in proportion to the power consumed by the evaporation. As a result, the total power supply from the mains to the apparatus and, accordingly, the rated wattage of the heater, can be confined within limits conventional to sauna heaters, which is not possible in the prior art construction, in which the resistors in the steamer and in the sauna heater are controlled independently of each other. The prior art apparatus requires a relatively high rated wattage, which in many cases cannot be provided. In addition, the sauna heater of the invention, having a rated wattage corresponding to that of a conventional electric sauna heater, can simply replace an existing sauna heater without having to modify the existing power supply arrangement.

Another preferred embodiment comprises a means for keeping at least one of the heating resistors of the sauna heater in operation after the evaporation has ended to ensure the drying of the sauna room. This element may be e.g. a timer which is started when power supplied to the evaporating resistor(s) is disconnected, or a humidity sensor disposed in the sauna room. This element enables the electric sauna heater of the invention to be used in traditional sauna rooms of wood structures, which is not possible with conventional steamers. This is because humidity in a steam bath is too high for conventional wood structures to be used; instead, the sauna room has to be made of plastic, stone or ceramic plates. With the electric sauna heater of the invention, wood structures can be used as well because the drying of the sauna room is ensured by positive control of at least one heating resistor.

Still another preferred embodiment of the invention, comprises a means for keeping at least one of the heating resistors of the sauna heater in operation to warm up the sauna room to a desired temperature before the generation of steam is started. In this way steam will not be fed directly into a cold sauna room, thus preventing the wetting of the cold wall surfaces through condensation of steam. According to this particular embodiment of the invention, the sauna room is first preheated to a desired temperature, thus considerably reducing the tendency of steam to condense on the wall surfaces so that the wetting of the walls is decreased. On account of the preheating, the desired bathing conditions can be achieved with less steam. Of course, the last-mentioned element can also be used in such a way that instead of preheating the sauna room it is heated to a normal bathing temperature (70° to 100° C.) and then some steam is generated in the sauna room. This steam creates a basic humidity in the sauna room, providing a so-called wet steam bath which most users find pleasant.

In the following the electric sauna heater of the invention will be described in greater detail with reference to the attached drawings, wherein FIG. 1 is a cross-sectional front view of the electric sauna heater of the invention;

Figure 1:
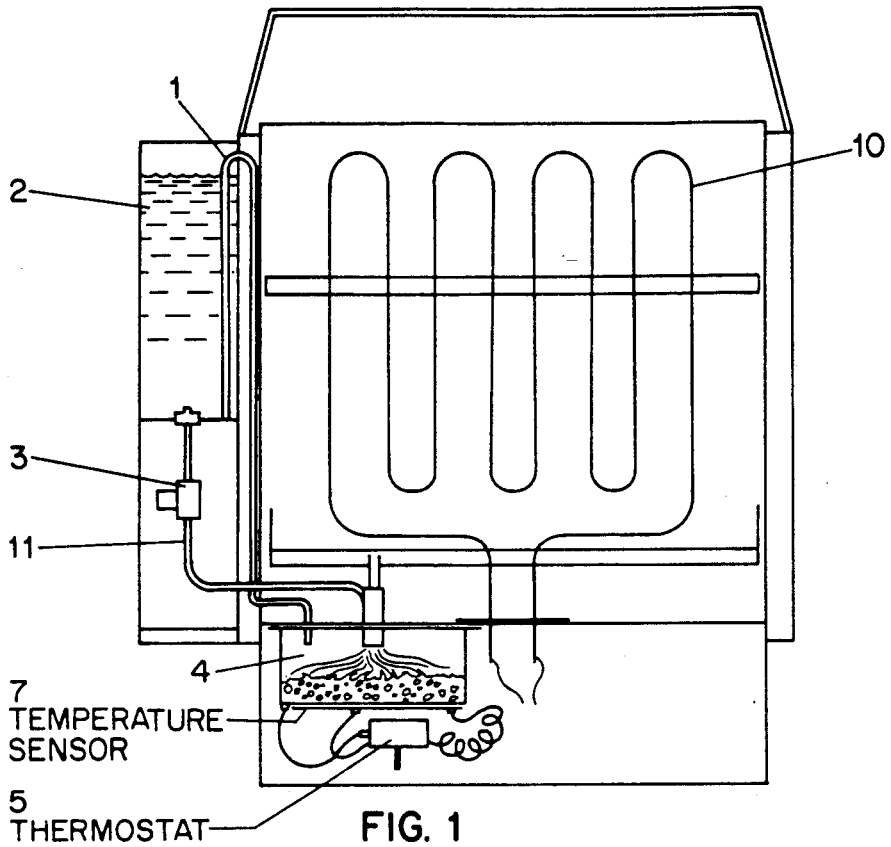

FIG. 1 shows the electric sauna heater of the invention, which comprises at least one heating resistor 10 for heating the room where the heater is positioned, that is, the sauna room. In the embodiment of FIG. 1, the space where the heating resistors 10 are positioned corresponds to the stone space in a conventional electric sauna heater, so that conventional sauna stones can be placed on the resistors if desired. So the sauna heater of the invention can be used as a conventional sauna heater, if desired. In this case it is provided with control and safety means required by conventional sauna heaters, such as a timer, thermostat, temperature limiter, etc.

Figure 2:
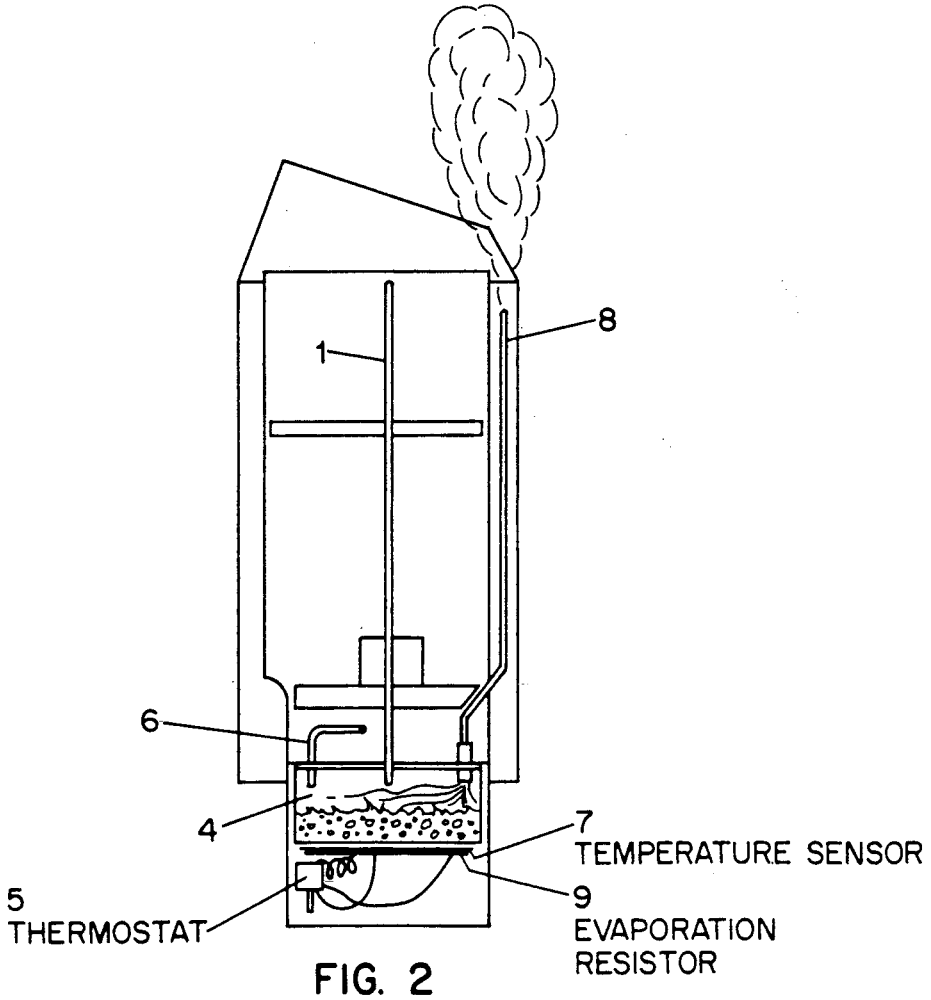
FIG. 2 is a side view of the sauna heater of FIG. 1.

In the embodiment of FIG. 1, a water tank 2 is provided on the side of the stone space, the water tank communicating by means of a conduit 11 with an evaporating space 4. The conduit 11 is provided with an electrically controlled valve 3 which controls the supply of water from the tank 2 into the evaporating space 4. As appears from FIG. 3 in particular, an evaporating resistor 9 controlled by a thermostat 5 is provided under the bottom of the evaporating space 4. A temperature sensor 7 of the thermostat 5 and the evaporating resistor 9 are arranged in direct contact with the outer surface of the evaporating space 4. In other words, the evaporating resistor 9 and the temperature sensor 7 are not positioned inside the boiler-like evaporating space 4 but on its outer surface. The evaporating space 4 is further provided with a steam discharge pipe 6 which joins a pipe 8 extending close to the top of the heater, as shown in FIG. 2. In this way, the condensation of steam on the possibly cold metal surfaces of the heater is prevented. The condensation can also be avoided according to the invention by preheating the sauna room before the generation of steam is begun. In addition, a pipe 1 acting as a safety valve is attached to the cover of the evaporating space 4. The pipe 1 extends from the cover of the evaporating space to the bottom of the water tank 2. If the steam discharge pipe 6 should be clogged for some reason with resultant pressure rise in the evaporating space, the steam would be able to discharge through the pipe 1 into the water tank 2 so as to be condensed therein without any risk of damage. In a normal case when the steam discharge pipe 6 is open, the pressure generated in the evaporating space 4 is too low for the steam to escape through the pipe 1.

In the following the operation of the steamer comprised in the sauna heater of the invention will be described in greater detail, referring to FIG. 3 in particular. The connection of FIG. 3, for instance, can be used to achieve the operation according to the invention, that is, when power is connected to the evaporating resistor 9 through the thermostat 5, at least one of the heating resistors of the sauna heater remains disconnected and the valve regulating the supply of water from the water tank 2 into the evaporating space 4 remains closed. Decrease in the amount of water in the evaporating space 4 causes the temperature of the bottom of the evaporating space to rise substantially over 100° C., whereby the thermostat 5 alters its position, disconnecting power from the evaporating resistor 9 and connecting power to at least one of the heating resistors 10 of the sauna heater, and in particular opening the valve 3 regulating the supply of water from the water tank 2. The valve thereby allows the passage of water from the water tank 2 into the evaporating space, which is cooled very rapidly. The sensor 7 reacts on the cooling of the evaporating space and connects power to the evaporating resistor 9, thus closing the valve 3. In this way, water is fed in doses from the water tank 2 into the evaporating space 4. As water is supplied in doses the evaporating resistor 9 need not have any particularly high capacity for the generation of steam to be started rapidly; substantially uninterrupted generation of steam can nevertheless be achieved. On the other hand, by connecting power alternatively to the evaporating resistor 9 and at least one of the heating resistors 10 of the sauna heater, the steamer does not increase the power demand as compared with the conventional sauna heater application.

When the water in the water tank runs out or the bathing is ended by disconnecting power from the evaporating resistor 9, the electric sauna heater of the invention is arranged to keep the resistor 10 in operation to ensure the drying of the sauna room. For this purpose, a switch 18 controlled by a timer 17 can be provided in the electric line supplying the resistor 10. The timer 17 is arranged to be restarted each time power is disconnected from the evaporating resistor 9 and to remain in operation for a desired period of time sufficient for the drying of the sauna room. The timer 17 operates even when the sauna heater is used in a conventional way without the use of the steamer. In this case the time set in the timer expires during the bathing and power is supplied to the resistor 10 by the thermostat 5. Thus no electricity is consumed after the bathing has been ended. Another way of ensuring the drying of the sauna room would be to provide a humidity sensor in the sauna room (see casing 16 in FIG. 4). The humidity sensor could be arranged to control the heating resistor 10, for instance, by suitable means known per se.

The electric sauna heater of the invention can also be used for generating steam in a sauna room heated to a conventional bathing temperature (70° to 100° C.). This steam can be generated in the sauna room already before bathing so as to create "a wet steam bath" in the sauna room. It is also possible to dose some water into the water tank 2 during bathing, which water is then automatically evaporated by the steamer, thus replacing either wholly or partly the conventional throwing of water on the sauna stones. Therefore it is not at all necessary to provide the sauna heater with stones to produce steam.

The electric sauna heater of the invention can also be controlled in such a way that even when it is desired that the bathing conditions resemble a steam bath, the sauna room is first preheated by means of the heating resistor of the heater to a desired temperature, such as 30° to 40° C. This kind of operation can be achieved by a thermostat 20 which connects power to the thermostat 5 after the desired temperature has been reached. When the generation of steam is then started, the generated steam will not condense on the walls of the sauna room to such an extent as without preheating. In this way the wetting of the wall structures of the sauna room is decreased which is of vital importance when wood materials for instance, are used. In addition, the preheating decreases the amount of steam required for achieving a desired humidity. This is mainly due to the fact that the steam will not condense on the wall surfaces in a preheated sauna room to such an extent as in a sauna room which has not been preheated.

Figure 4:
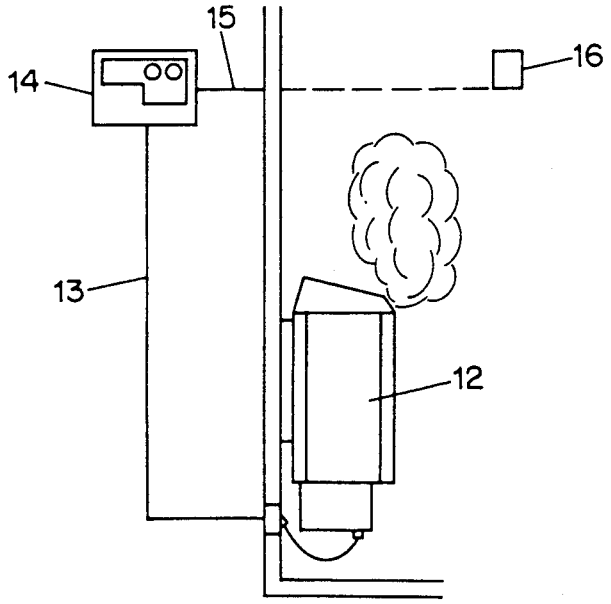
FIG. 4 shows by way of example how the electric sauna heater of FIG. 1 is mounted on the wall of a sauna room.

FIG. 4 illustrates the electric sauna heater 12 of the invention when installed on the wall of a sauna room. The sauna heater 12 is connected by means of a capable 13 to a control unit 14 disposed outside the sauna room. The control unit 14 is connected by means of a cable 15 to a casing 16 disposed on the wall of the sauna room and containing a humidity sensor and possibly also a temperature limiter.

The electric sauna heater of the invention and particularly the different applications and bathing conditions offered by it have been described above only by way of example by means of a few specific embodiments and it is to be understood that the constructions described can be modified to vary the bathing conditions without deviating from the scope defined by the attached claims. Accordingly, the scope of protection can be regarded to include a case in which the sauna heater comprises only the heating resistors considered necessary for the drying of the sauna room while the heat as well as the steam are generated by means of the steamer. In this case it would, of course, be possible to omit the stone space of the sauna heater and vary the appearance of the construction of the resistor 10. The safety arrangements required when using the sauna heater of the invention have not, either, been described above. Such safety arrangements aim at preventing the concurrent occurrence of a high temperature and a high relative humidity, which might be highly dangerous. On the other hand, this concurrent occurrence can be avoided in the sauna heater according to the invention simply by providing the steamer with such a low capacity that it is able to maintain steam bath conditions in the sauna room, that is, a temperature of about 40° C. and a relative humidity of about 100%. As a consequence, when the generation of steam is stopped and the heating resistors of the heater are connected to full capacity the relative humidity to be obtained at a temperature of about 100° C. cannot exceed 20%, which can be regarded as safe. Another simple alternative to avoid the concurrent occurrence of high temperature and high relative humidity is to connect the heating resistors so that they alternate with the evaporating resistor, that is, they cannot operate simultaneously.

Figure 3:
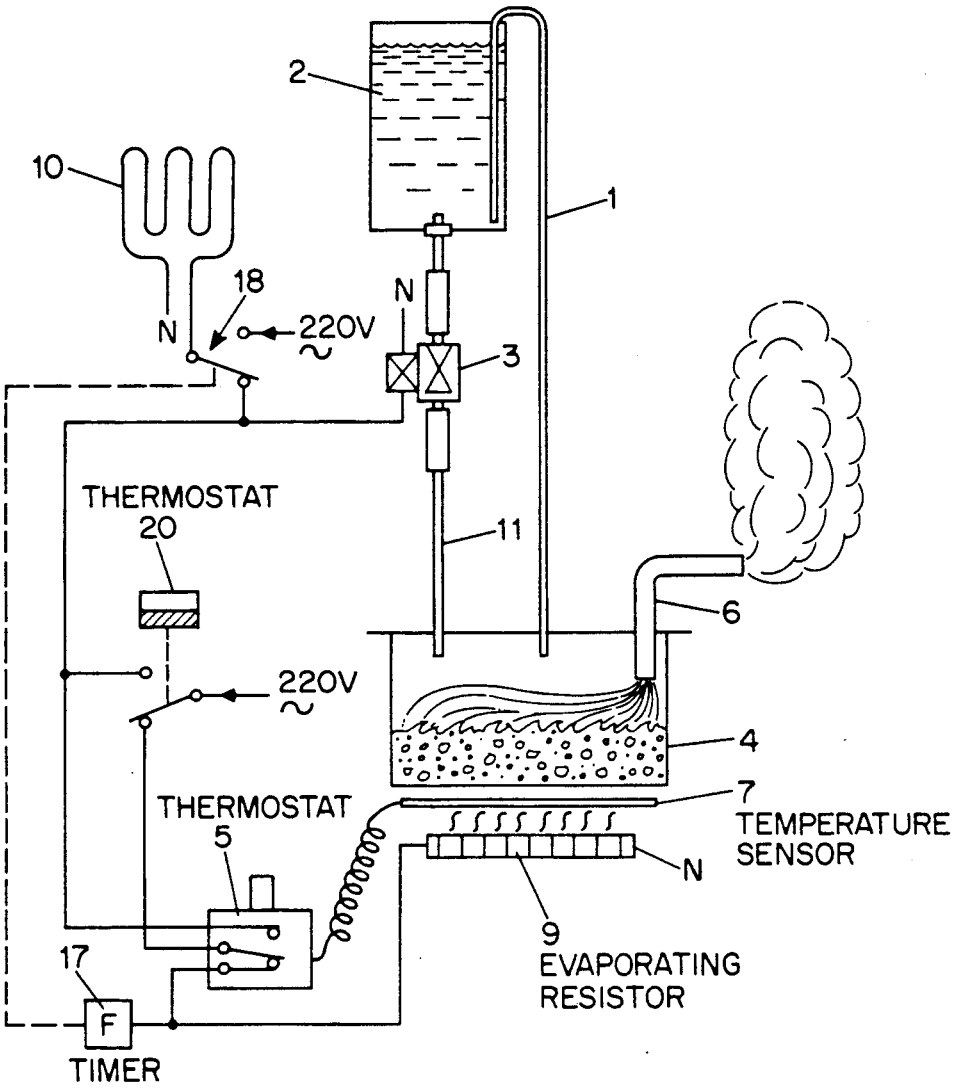
FIG. 3 is a more detailed view of a steamer in the electric sauna heater of FIG. 1.

Furthermore, the embodiment of the invention shown in FIGS. 1 to 3 can be modified so that it does not comprise any water tank but the valve 3 is directly attached to the pipeline network. It is also possible to effect a corresponding continuous operation in such a way that the water tank 2 is supplied from the pipeline network, whereby the level of the surface of the water contained in the water tank is controlled by means of a suitable swimmer, for instance.

We claim:

1. An electric sauna heater for a sauna room, comprising:

at least one electrical resistor for heating the sauna room when supplied with electric power;

means defining an evaporation space for containing water and having an exterior surface;

means including a water supply communicating with said evaporation space and valve means for controllably feeding water to said evaporation space;

at least a second electric resistor disposed adjacent to the exterior surface of said evaporation space, which when energized, evaporates the water contained in said space; and thermostatic control means including a sensor disposed adjacent to the exterior surface of said evaporating space and responsive to an increase in temperature from a predetermined temperature caused by lack of water in the evaporation space to deenergize said second resistor and to open said valve means for supplying water to said evaporation space in an amount sufficient to reduce the temperature to said predetermined temperature and then to close said valve means and reenergize said second resistor.

2. An electric sauna heater according to claim 1, wherein the thermostatic control means are arranged to deenergize at least one of the heating resistors of the sauna heater while energizing the water evaporating resistor, and to energize at least one of the heating resistors of the sauna heater while deenergizing the water evaporating resistor.

3. An electric sauna heater according to claim 1, further comprising a means for keeping at least one of the heating resistors of the sauna heater in operation to heat the sauna room to a desired temperature before starting the generation of steam.

4. An electric sauna heater according to claim 3, wherein said means is a switch controlled by a thermostat.

5. An electric sauna heater according to claim 1, further comprising a means for keeping at least one of the heating resistors of the sauna heater in operation after the generation of steam has ended to ensure the drying of the sauna room.

6. An electric sauna heater according to claim 5, wherein said means is a timer arranged to be started when the supply of power to the evaporating resistor(s) is disconnected.

7. An electric sauna heater according to claim 5, wherein said means is a humidity sensor disposed in the sauna room.

* * * * *